US009885176B2

(12) United States Patent
Cornelus et al.

(10) Patent No.: US 9,885,176 B2
(45) Date of Patent: Feb. 6, 2018

(54) MASONRY REINFORCEMENT STRUCTURE COMPRISING PARALLEL CORDS

(71) Applicant: NV BEKAERT SA, Zwevegem (BE)

(72) Inventors: Henk Cornelus, Avelgem (BE); Ann Lambrechts, Avelgem (BE); David Six, Waasmunster (BE); Veerle Van Wassenhove, Aarsele (BE); Frederik Vervaecke, Ghent (BE)

(73) Assignee: NV BEKAERT SA, Zwevegem (BE)

( * ) Notice: Subject to any disclaimer, the term of this patent is extended or adjusted under 35 U.S.C. 154(b) by 0 days.

(21) Appl. No.: 15/398,418

(22) Filed: Jan. 4, 2017

(65) Prior Publication Data

US 2017/0175387 A1 Jun. 22, 2017

Related U.S. Application Data

(62) Division of application No. 14/771,984, filed as application No. PCT/EP2014/056684 on Apr. 3, 2014, now abandoned.

(30) Foreign Application Priority Data

Apr. 4, 2013 (EP) ..... 13162259
Apr. 4, 2013 (EP) ..... 13162261

(51) Int. Cl.
*E04B 2/06* (2006.01)
*E04C 2/28* (2006.01)
(Continued)

(52) U.S. Cl.
CPC ..... *E04B 2/06* (2013.01); *D03D 15/02* (2013.01); *D04B 21/14* (2013.01); *D04H 3/002* (2013.01);
(Continued)

(58) Field of Classification Search
CPC ..... E04G 23/0218; D07B 1/062; E04C 5/073; E04C 2/28; E04C 5/012; D04B 21/14; D03D 15/02; E04B 2/06
(Continued)

(56) References Cited

U.S. PATENT DOCUMENTS 874,881 A * 12/1907 Baker ..... E04B 1/2608 52/694
4,257,993 A * 3/1981 Schemel ..... B28B 23/0006 264/112
(Continued)

FOREIGN PATENT DOCUMENTS

EP 1602469 A1 * 12/2005 ..... B29C 70/023
EP 1602469 A1 * 12/2005 ..... B29C 70/023
(Continued)

OTHER PUBLICATIONS

International Search Report for PCT/EP2014/056684 dated Jun. 12, 2014.

*Primary Examiner* — Brian E Glessner
*Assistant Examiner* — Adam G Barlow
(74) *Attorney, Agent, or Firm* — Bacon & Thomas, PLLC

(57) ABSTRACT

A masonry reinforced with at least one bed joint masonry reinforcement structure. The bed joint reinforcement structure includes at least two cords, which have metal filaments that are twisted together. The cords are oriented parallel or substantially parallel in the length direction of the masonry reinforcement structure.

10 Claims, 3 Drawing Sheets

(51) Int. Cl.

| | |
|---|---|
| ***E04C 5/01*** | (2006.01) |
| ***E04C 5/07*** | (2006.01) |
| ***D03D 15/02*** | (2006.01) |
| ***D04B 21/14*** | (2006.01) |
| ***D07B 1/06*** | (2006.01) |
| ***D04H 3/002*** | (2012.01) |
| *E04G 23/02* | (2006.01) |

(52) U.S. Cl.
CPC ..... *D07B 1/062* (2013.01); *E04C 2/28* (2013.01); *E04C 5/012* (2013.01); *E04C 5/073* (2013.01); *D10B 2403/02411* (2013.01); *D10B 2505/02* (2013.01); *E04G 2023/0251* (2013.01)

(58) Field of Classification Search
USPC ..... 52/378, 379, 660–664, 694, 712
See application file for complete search history.

(56) References Cited

U.S. PATENT DOCUMENTS

| | | | | |
|---|---|---|---|---|
| 4,472,086 | A | 9/1984 | Leach | |
| 2016/0010348 | A1* | 1/2016 | Cornelus ..... | D04B 21/14<br>52/741.3 |

FOREIGN PATENT DOCUMENTS

| | | | |
|---|---|---|---|
| EP | 1602496 | A1 | 12/2005 |
| EP | 1690966 | A1 | 8/2006 |
| WO | 2004/101909 | A1 | 11/2004 |
| WO | 2009/062764 | A1 | 5/2009 |

* cited by examiner

MASONRY REINFORCEMENT STRUCTURE COMPRISING PARALLEL CORDS

The invention relates to a masonry reinforcement structure comprising parallel cords, more particularly to a masonry bed joint reinforcement structure. The invention also relates to a roll comprising such a masonry reinforcement structure. The invention further relates to masonry reinforced with such masonry reinforcement structure and to a method to apply such masonry reinforcement structure.

BACKGROUND ART

Masonry has a high compressive strength but a limited tensile strength. This leads to limitations in the design of masonry (such as limited height, limited width, limited length of masonry) and may lead to cracking when tensile and/or shear stresses develop in the masonry.

Bed joint reinforcement, for example prefabricated bed joint reinforcement of steel meshwork, is a proven technology for allowing masonry to carry higher loads (e.g. wind loads) by providing additional strength and flexibility, and for controlling cracks in masonry that is subject to tensile forces.

Bed joint reinforcement of steel meshwork for structural use (according to definitions of EN 845:3) generally comprise welded wire meshwork, such as two parallel longitudinal wires connected by a continuous zig-zag wire (truss type) or connected by straight cross wires (ladder type).

Prefabricated bed joint reinforcement structures typically have a length of about 3 m, for example 2.70 m or 3.05 m. This relatively long length makes the transportation, storing and handling of the structures complex.

To secure continuous reinforcement and to avoid weak points in reinforced masonry, overlapping of neighbouring prefabricated bed joint reinforcement elements is necessary and common practice. Overlapping leads to higher material consumption as double amount of material is required in the overlap zones.

Furthermore, as overlaps between neighbouring bed joint reinforcement structures may not be located at areas of high stress or at areas where the dimensions of a section change (for example a step in a wall height or thickness), the work of the installer of bed joint reinforcement elements is complicated.

SUMMARY OF THE INVENTION

It is an object of the present invention to provide an improved masonry reinforcement structure avoiding the drawbacks of the prior art. It is another object of the present invention to provide a masonry reinforcement structure that can easily be rolled up and rolled out. It is a further object of the present invention to provide a masonry reinforcement structure that when rolled out lies and remains in a flat position making additional precautions or steps to obtain a flat position of the masonry reinforcement structure superfluous.

It is a further object of the present invention to provide a masonry reinforcement structure that can be provided in rolls of long length. It is a further object of the present invention to provide a masonry reinforcement structure that makes the use and handling of the masonry reinforcement structure easy, for example the use and handling on a construction site.

It is a further object of the present invention to provide a masonry reinforcement structure that allows to minimize the number of overlaps between neighbouring structures.

It is still a further object of the present invention to provide a masonry reinforcement structure having a minimal thickness allowing easy positioning in the joints (for example glue joints or mortar joints).

According to a first aspect of the present invention a masonry reinforcement structure comprising at least two cords is provided. The masonry reinforcement structure has a length direction. The cords are oriented parallel or substantially parallel in the length direction of the masonry reinforcement structure. The cords comprise metal filaments that are twisted together.

The masonry reinforcement structure according to the present invention comprises preferably a bed joint reinforcement structure.

A bed joint reinforcement structure is defined as a reinforcement structure that is prefabricated for building into a bed joint.

The masonry reinforcement structure has a length L and a width W, with L being larger than W.

With "parallel" or "substantially parallel" is meant that the main axes of the cords are parallel or substantially parallel to each other.

With "substantially parallel" is meant that there may be some deviation from the parallel position. However, if there is a deviation, the deviation from the parallel position is either small or accidental. With small deviation is meant a deviation less than 5 degrees and preferably less than 3 degrees or even less than 1.5 degrees.

The cords of a masonry reinforcement structure according to the present invention are parallel or substantially parallel over the full length of the masonry reinforcement structure. The cords are not intertwisted or interconnected.

Cords

For the purpose of this invention with "a cord" is meant any unit or group of a number of filaments that are twisted. Cords comprise single strand cords or multistrand cords. The twisting can be obtained by cabling or bunching.

A masonry reinforcement structure according to the present invention comprising cords has the advantage that the structure can easily be rolled up and rolled out. Furthermore a masonry reinforcement structures comprising cords lies in a flat position when rolled out and remains in this flat position without requiring additional precautions or steps to obtain or maintain this flat position.

The number of filaments in a cord ranges preferably between 2 and 100, for example between 2 and 81, between 2 and 20, for example 6, 7, 10 or 12.

Filaments

As metal filaments any type of elongated metal filaments can be considered. Any metal can be used to provide the metal filaments. Preferably, the metal filaments comprise steel filaments. The steel may comprise for example high carbon steel alloys, low carbon steel alloys or stainless steel alloys.

The metal filaments preferably have a tensile strength higher than 1000 MPa, for example higher than 1500 MPa or higher than 2000 MPa.

The filaments have a diameter preferably ranging between 0.04 and 2.00 mm. More preferably, the diameter of the filaments ranges between 0.10 and 1 mm as for example between 0.2 and 0.5 mm, for example 0.25, 0.33, 0.37, 0.38 or 0.45 mm.

All filaments of a cord may have the same diameter. Alternatively, a cord may comprise filaments having different diameters.

A cord may comprise one type of filaments. All filaments of a cord have for example the same diameter and the same composition.

Alternatively, a cord may comprise different types of filaments, for example filaments having different diameter and/or different compositions.

The filaments of a cord may all be of the same type, for example all filaments of a cord may comprise metal filaments. Alternatively, a cord comprises non-metal filaments next to metal filaments. Examples of non-metal filaments comprise carbon or carbon based filaments of yarns, polymer filaments or polymer yarns, such as filaments or yarns made of polyamide, polyethylene, polypropylene, polyvinyl alcohol or polyester. Also glass yarns or rovings of glass filaments can be considered.

The filaments preferably have a circular or substantially circular cross-section although filaments with other cross-sections, such as flattened filaments or filaments having a square or a substantially square cross-section or having a rectangular or a substantially rectangular cross-section can be considered as well.

The filaments can be uncoated or can be coated with a suitable coating, for example a coating giving corrosion protection.

Suitable coatings comprise a metal coating such as a zinc or zinc alloy coating or a polymer coating. Examples of metal or metal alloy coatings comprise zinc or zinc alloy coatings, for example zinc brass coatings, zinc aluminium coatings or zinc aluminium magnesium coatings. A further suitable zinc alloy coating is an alloy comprising 2 to 10% Al and 0.1 to 0.4% of a rare earth element such as La and/or Ce.

Examples of polymer coatings comprise polyethylene, polypropylene, polyester, polyvinyl chloride or epoxy.

For a person skilled in the art it is clear that a coating such as a coating giving corrosion protection can be applied on the filaments. However, it is also possible that a coating is applied on a cord.

Number of Cords

A masonry reinforcement structure according to the present invention comprises at least two cords. In principle there is no limitation to the number of cords. Preferably, the number of cords ranges between 2 and 500, for example between 4 and 300. The number of cords is for example 10, 20, 50, 100, 200 or 300.

Preferably, the different cords of a masonry reinforcement structure according to the present invention are spaced apart. The distance between cords may vary within a wide range, the distance between neighbouring cords is for example higher than 1 mm and lower than 80 cm. The distance between neighbouring is for example ranging between 1 mm and 10 cm, for example 5 mm, 1 cm, 2 cm, 3 cm, 5 cm, 7 cm or 8 cm. For many applications a minimum distance between neighbouring cords is preferred as this results in a better embedment of the cords in the mortar or glue.

The distance between neighbouring cords can be equal over the width of the structure of the masonry reinforcement structure.

Alternatively, it can be preferred that the distance between neighbouring cords is lower in some areas of the masonry reinforcement structure, for example in areas where stresses are high.

The distance between neighbouring cords can for example be lower at the outer sides of the masonry reinforcement structure compared to the distance between neighbouring cords in the middle portion of the masonry reinforcement structure.

A masonry reinforcement structure according to the present invention may comprise one type of cords. All cords of a masonry reinforcement structure have for example the same construction and comprise the same material.

Alternatively, a masonry reinforcement structure comprises a number of different types of cords, for example cords having a different construction.

A masonry reinforcement structure according to the present invention comprises cords that are in a mutual parallel position or in a mutual substantially parallel position oriented in the length direction of the masonry reinforcement structure.

Preferably, the cords are kept and secured in their mutual parallel or mutual substantially parallel position and this during manufacturing, transporting, installation and once installed.

The cords are for example kept in their mutual parallel or mutual substantially parallel position by coupling the cords to a substrate or by integrating the cords in a structure.

The term 'coupled to a substrate' should be understood in a broad meaning and includes all possible manners whereby the cords are coupled to a substrate. For the purpose of this invention coupling includes connecting, joining, bonding, gluing, adhering, laminating . . . . The cords can be coupled, joined, bonded, glued, adhered, laminated to the substrate by any technique known in the art. Preferred techniques comprise stitching, knitting, embroidering, gluing, welding and melting. As substrate any substrate allowing the coupling of the cords to can be considered, either substrates comprising a metal or a non-metal material or substrates comprising both a metal and a non-metal material. Suitable substrates comprise woven structures, non-woven structures, films, strips, foils, meshes, grids or foams.

As non-woven substrates needlebonded, waterbonded, spunbonded, airlaid, wetlaid or extruded substrates can be considered.

Preferred foils or grids are foils or grids obtained by extrusion, for example foils or grids comprising polypropylene, polyethylene, polyamide, polyester or polyurethane.

Preferred metal substrates comprise metal grids or metal meshes, for example steel grids or steel meshes.

The substrate may comprise an open structure or alternatively a closed structure. A substrate having an open structure has the advantage that it is permeable for the glue or mortar when installed in the masonry. Furthermore open structures have a lower weight and higher flexibility.

Substrates comprising a non-metal material comprise for example glass, carbon or polymer material. Preferred polymer materials comprise polyester, polyamide, polypropylene, polyethylene, polyvinyl alcohol, polyurethane, polyethersulphone, or any combination thereof.

As metal substrates steel substrates, for example substrates made of steel wire such as meshes or grids can be considered.

A preferred way of coupling the cords to a substrate is by gluing the cords to a substrate, for example a substrate comprising carbon or carbon based filaments of yarns, polymer filaments or polymer yarns or glass yarns or rovings. Any type of glue of hot melt suitable to couple the cords to the substrate can be considered.

Another preferred way of coupling the cords to a substrate is by using at least one yarn. Possibly, the number of yarns used is higher than 1. The number of yarns is for example ranging between 1 and 100; for example ranging between 1 and 50, for example 10.

The at least one yarn holds the cords in their mutual parallel or substantially parallel position and ensures that the cords are secured in their mutual parallel or mutual substantially parallel position and this during the manufacturing, storing, transporting, installation and use of the masonry reinforcement structure.

Preferably, the at least one yarn forms stitches to couple the cords to the substrate. The stitches are preferably formed around the cords. The stitches are preferably formed by at least one operation selected from stitching, knitting or embroidering.

Yarn

The yarn comprises preferably a textile yarn.

For the purpose of this invention with "yarn" is meant any fiber, filament, multifilament of long length suitable for use in the production of textiles. Yarns comprise for example spun yarns, zero-twist yarns, single filaments (monofilaments) with or without a twist, narrow strip of materials with or without twist, intended for use in a textile structures.

The at least one yarn may comprise a natural material, a synthetic material or a metal or metal alloy.

Preferred synthetic materials comprise polyamide, polyether sulphone, polyvinyl alcohol and polypropylene yarn. Also yarns made of glass, such as glass fibers can be considered.

Preferred metal or metal alloys comprise steel such as low carbon steel, high carbon steel or stainless steel.

Preferably, the yarn used in the structure for the masonry reinforcement structure is suitable for use in a textile operation such as sewing, stitching, knitting, embroidery and weaving.

In order to be suitable in a textile operation and more particularly in a sewing, knitting or embroidery operation, the yarn is preferably bendable.

Preferably, the at least one yarn can be bent to a radius of curvature smaller than 5 times the equivalent diameter of the yarn. More preferably the at least one yarn can be bent to a radius of curvature lower than 4 times the diameter of the yarn, lower than 2 times the diameter of the yarn or even lower than the diameter of the yarn.

Furthermore the yarn used is preferably suitable to hold and secure the cords in their mutual parallel or mutual substantially parallel position. It is clear that the yarn used preferably allows to maintain the flexibility of the structure so that the structure can be rolled up and rolled out easily.

Also the term 'integrated in a structure' should be understood in a broad meaning and includes all possible manners whereby the cords are integrated in a structure or substrate. For the purpose of this invention integrating the cords in a structure includes embedding the cords in a matrix material such as a polymer matrix material. The cords are for example embedded in a polymer strip.

Integrating the cords in a structure also includes the integration of the cords during the manufacturing of the structure, for example the integration of the cords in a woven structure during the manufacturing of the woven structure or of a knitted structure during the manufacturing of the knitted structure. Similarly, the cords can be integrated in a non-woven structure during the manufacturing of the non-woven structure. For a woven structure the cords are for example integrated in the warp direction of the woven structure. For a knitted structure the cords are for example integrated in the longitudinal direction of the knitted structure.

In a preferred embodiment the masonry reinforcement structure comprises a woven structure comprising cords in the warp direction. The weft direction comprises for example the least one yarn. In such woven structure the cords are hold in their mutual parallel or mutual substantially parallel position by the at least one yarn.

For a person skilled in the art it is clear that a woven fabric according to the present invention may comprise other elements such as yarns in the warp direction next to the cords.

The woven fabric according to the present invention may also comprise cords in the weft direction.

In another preferred embodiment the masonry reinforcement structure comprises a knitted structure wherein the stitches are formed by at least one yarn.

Thanks to the high flexibility of the masonry reinforcement structure, the masonry reinforcement structure can easily be rolled up and rolled out. Furthermore when rolled out the masonry reinforcement structure lies in a flat position and remains in a flat position without requiring additional precautions or steps to obtain a flat position.

This makes the use at a construction site easy. The masonry reinforcement structure can be rolled out on a masonry structure, for example on a layer of bricks or blocks.

The masonry reinforcement structure can be easily cut to the required length.

As the masonry reinforcement structure can be provided at long lengths, the number of overlaps between neighbouring masonry reinforcement structures is substantially reduced compared to masonry reinforced with prefabricated bed joint reinforcement structures presently known in the art.

A further advantage of a masonry reinforcement structure according to the present invention is the minimal thickness of the masonry reinforcement structure allowing easy positioning in the joints (for example glue joints or mortar joints).

The masonry reinforcement structure may have an open structure or alternatively a closed structure. A masonry reinforcement structure having an open structure has the advantage that it that it is permeable for the glue or mortar. Furthermore open structures have a lower weight and higher flexibility.

In preferred embodiments the masonry reinforcement structure consists of metal, for example of steel. As such masonry reinforcement structure consists of one material, this may simplify the recycling of the masonry reinforcement structure or of a masonry structure reinforced with a masonry reinforcement structure.

Examples of masonry reinforcement structures consisting of steel comprise

- steel cords coupled to a steel substrate, for example steel cords coupled to a steel mesh by means of a steel yarn;
- steel cords integrated in a woven structure, for example a woven structure consisting of steel cords and a steel yarn or a number of steel yarns;
- steel cords integrated in a knitted structure, for example a knitted structure consisting of steel cords and a steel yarn or a number of steel yarns.

According to a second aspect of the present invention a method to manufacture a masonry reinforcement structure is provided.

The method comprises the steps of:

- providing at least two cords, said cords comprising twisted filaments;

manufacturing a masonry reinforcement structure comprising said at least two cords, said at least two cords being oriented parallel or substantially parallel in the length direction of the masonry reinforcement structure.

A preferred method of manufacturing a masonry reinforcement structure according to the present invention comprises the steps of providing at least two cords;

providing a substrate;

coupling said at least two cords to said substrate in a substantially parallel direction in the length direction of said structure.

The coupling of the at least two cords to the substrate is preferably obtained by stitching, knitting, embroidering, gluing, laminating, welding or melting.

A further method of manufacturing a masonry reinforcement structure according to the present invention comprises the steps of providing at least two cords of twisted filaments;

integrating said at least two cords in said structure during the manufacturing of said structure.

The cords are for example integrated in a polymer strip, for example during extrusion of the polymer material.

In other methods, the cords are integrated in a woven structure, for example during the weaving of the woven structure. The cords are for example integrated in the warp direction of the woven structure. In a further method the cords are integrated in a knitted structure, for example during the manufacturing of the knitted structure.

In still a further method, the cords are integrated in a non-woven structure, for example in a spunlaid or wetlaid structure during the manufacturing of the structure.

Still a further method of manufacturing a masonry reinforcement structure according to the present invention comprises the steps of providing at least two cords, said cords comprising twisted filaments;

providing a substrate;

manufacturing a welded, woven, knitted or braided structure comprising said at least two cords in a substantially parallel direction in the length direction of said structure;

coupling said welded, woven, knitted or braided structure to said substrate, preferably by stitching, knitting, embroidering, gluing, welding or melting.

According to a third aspect of the present invention a roll of a masonry reinforcement structure as described above is provided. The masonry reinforcement structure is wound or coiled to form said roll.

As the masonry reinforcement structure according to the present invention is flexible, the structure can easily be rolled up and rolled out.

According to a fourth aspect of the present invention a method to install a masonry reinforcement structure as described above is provided.

The method to install the masonry reinforcement structure comprises the steps of providing masonry comprising at least one layer of units or bricks;

uncoiling a masonry reinforcement structure as described above and if required cutting the masonry reinforcement structure to the desired length;

installing said masonry reinforcement structure in a joint (for example in a mortar or glue joint) on the upper surface of the last layer of units or bricks;

providing the next layer of units or bricks on said joint.

The masonry reinforcement structure can be installed in said joint by first applying a layer of mortar or glue on the upper surface of the last layer of units or bricks and by subsequently applying the masonry reinforcement structure.

Alternatively, the masonry reinforcement structure can be installed in said joint by first applying the masonry reinforcement structure on the upper surface of the last layer of units or bricks and by subsequently applying a layer of mortar or glue on the masonry reinforcement structure.

In a further method a first layer of mortar or glue is applied on the upper surface of the last layer of units or bricks, the masonry reinforcement structure is applied on the masonry reinforcement structure, followed by the application of a second layer of mortar or glue on the masonry reinforcement structure.

According to a fifth aspect of the present invention masonry reinforced with at least one masonry reinforcement structure according to the present invention is provided.

The masonry comprises a number of layers of units or bricks and joints between two neighbouring layers of units or bricks. At least one joint is reinforced by a masonry reinforcement structure according to the present invention.

The joints may comprise mortar joints or glue joints.

BRIEF DESCRIPTION OF THE DRAWINGS

The invention will now be described into more detail with reference to the accompanying drawings whereby.

DETAILED DESCRIPTION OF THE INVENTION

Figure 1:
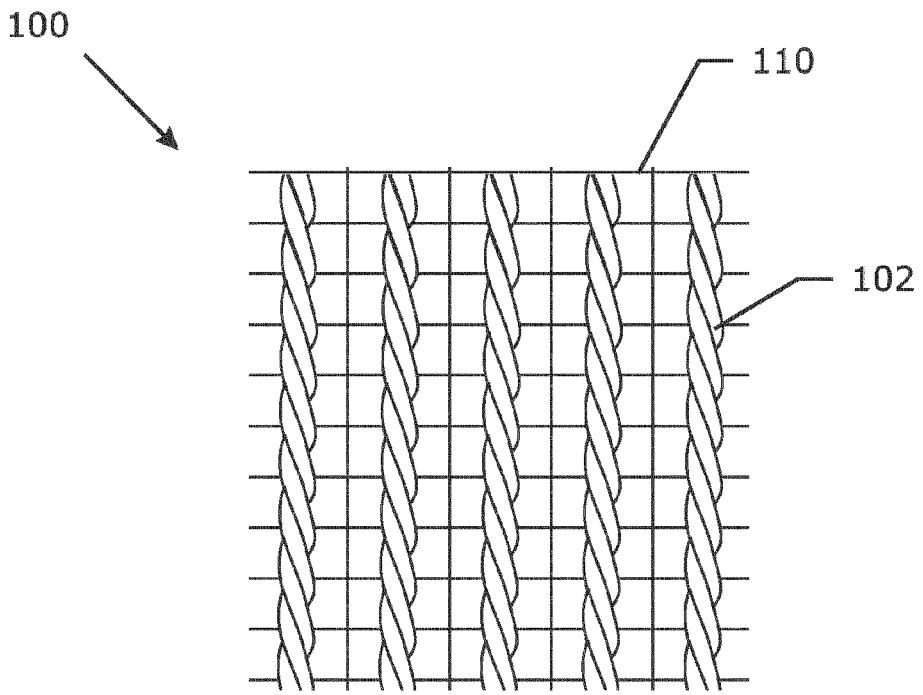
FIG. 1 is an illustration of a masonry reinforcement structure comprising cords glued to a substrate.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not correspond to actual reductions to practice of the invention.

The following terms are provided solely to aid in the understanding of the inventions:

Masonry: all building systems that are constructed by stacking units of for example stone, clay, or concrete, joined by for example mortar or glue into the form of for example walls, columns, arches, beams or domes;

Equivalent diameter of a yarn or filament: the diameter of an imaginary yarn or filament having a circular radial cross-section, which cross-section has a surface identical to the surface area of the particular yarn or filament FIG. 1 is an illustration of a masonry reinforcement structure 100 comprising parallel cords 102 glued to a substrate 110. A preferred steel cord 102 comprises between 2 and 12 filaments, for example a cord having one core filament having a diameter of 0.37 mm and 6 filaments having a diameter of 0.33 m around this core filament (0.37+6×0.33). The steel cords 102 are oriented in a substantially parallel position. The substrate 110 comprises for example a woven or non-woven polymer structure. Preferably, the substrate 110 has an open structure.

The steel cords 102 are glued to a substrate 110.

The substrate 110 may comprise a polymer material, glass, carbon, metal such as steel or any combination thereof. The substrate 110 is for example a grid or foil obtained by extrusion. Alternatively the substrate 110 comprises a woven or non-woven structure, for example a woven or non-woven polymer structure or a woven or non-woven metal substrate. Examples of non-woven structures comprise a needlepunched or spunbond non-woven substrate, for example in polyamide, polyether sulphone of polypropylene.

In a preferred embodiment the structure 100 comprises steel cords 102 that are glued to a non-woven polyether sulphone substrate 110 or to an extruded polypropylene grid (35 g/m$^2$ having a 6×6 mm mesh). In another preferred embodiment the structure 100 comprises steel cords 102 that are glued to a substrate 110 made of glass fibers or glass rovings or to a substrate 110 comprising carbon filaments.

Figure 2:
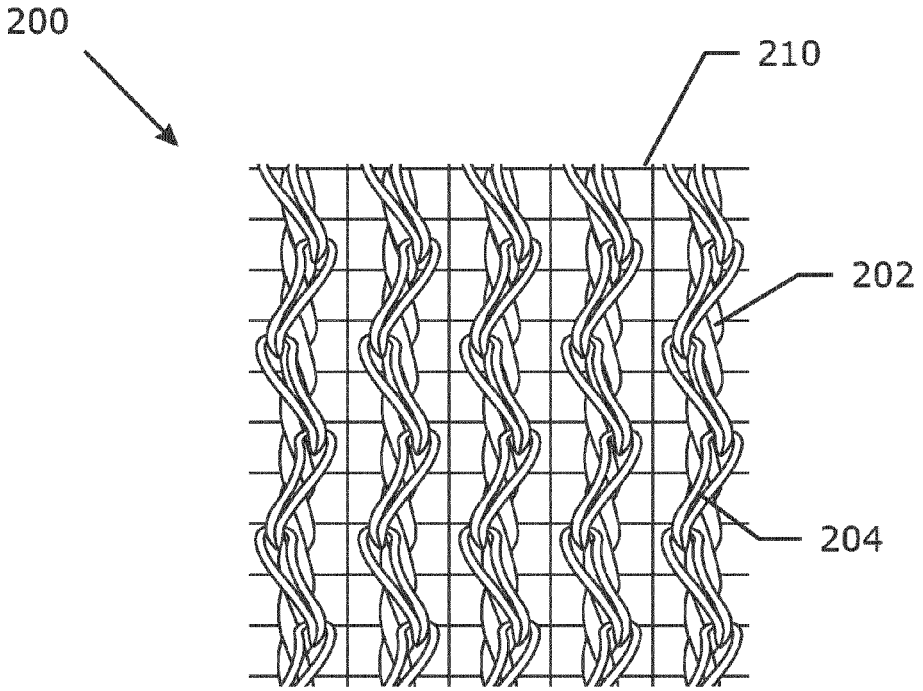
FIG. 2 is an illustration of a masonry reinforcement structure comprising cords stitched to a substrate.

FIG. 2 is an illustration of a masonry reinforcement structure 200 comprising parallel cords 202 stitched to a substrate 210 by means of yarn 204. The cords 202 are for example steel cords comprising 3 filaments having a diameter of 0.48 mm twisted together (3×0.48 mm). The yarn 204 forms stitches to hold the cords 202 in their mutual parallel or mutual substantially parallel position.

The substrate 210 comprises for example a woven or non-woven polymer structure.

In a preferred embodiment the cords comprise steel cords that are stitched to a polymer substrate for example a non-woven polyether sulphone substrate by means of a polyether sulphone yarn.

In another preferred embodiment the cords are steel cords stitched to a metal substrate, for example a steel mesh or steel grid by a metal yarn, for example a steel yarn. Such structure fully consisting of one material, more particularly metal (steel) is easier to recycle compared to structures comprising a number of different materials.

Figure 3:
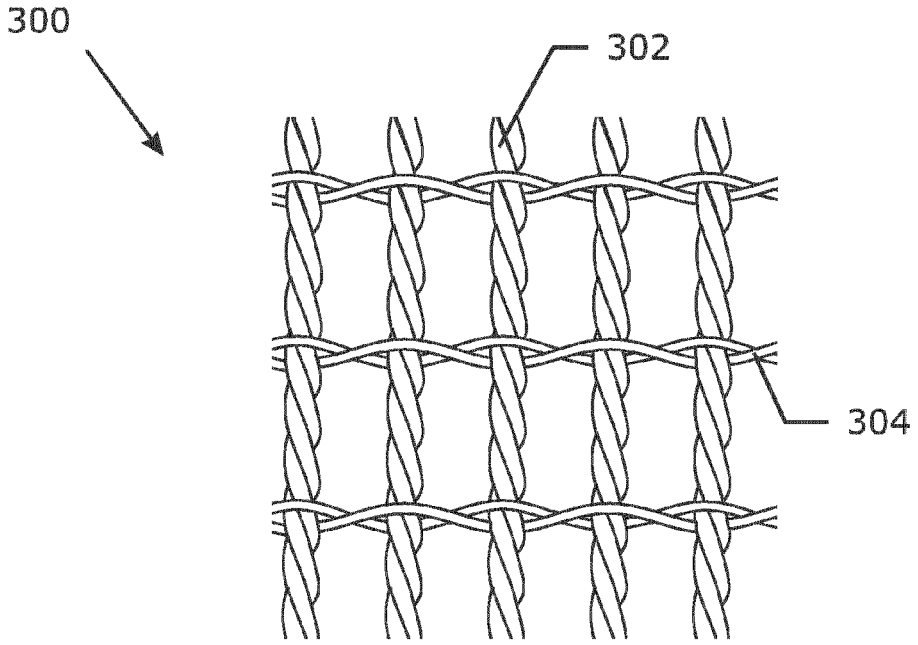
FIG. 3 is an illustration of a masonry reinforcement structure comprising cords in a woven structure.

FIG. 3 is an illustration of a masonry reinforcement structure 300 comprising a woven structure. The woven structure 300 comprises steel cords 302 in the warp direction. A preferred steel cord comprises between 2 and 12 filaments, for example a cord having one core filament having a diameter of 0.37 mm and 6 filaments having a diameter of 0.33 m around this core filament (0.37+6×0.33).

The weft direction comprises for example a polymer yarn 304, such as a polyamide, a polyether sulphone, a polyvinyl alcohol or a polypropylene yarn.

The masonry reinforcement structure 300 is preferably an open structure permeable for the glue or mortar.

It is clear for a person skilled in the art that different weave patterns can be considered.

Figure 4:
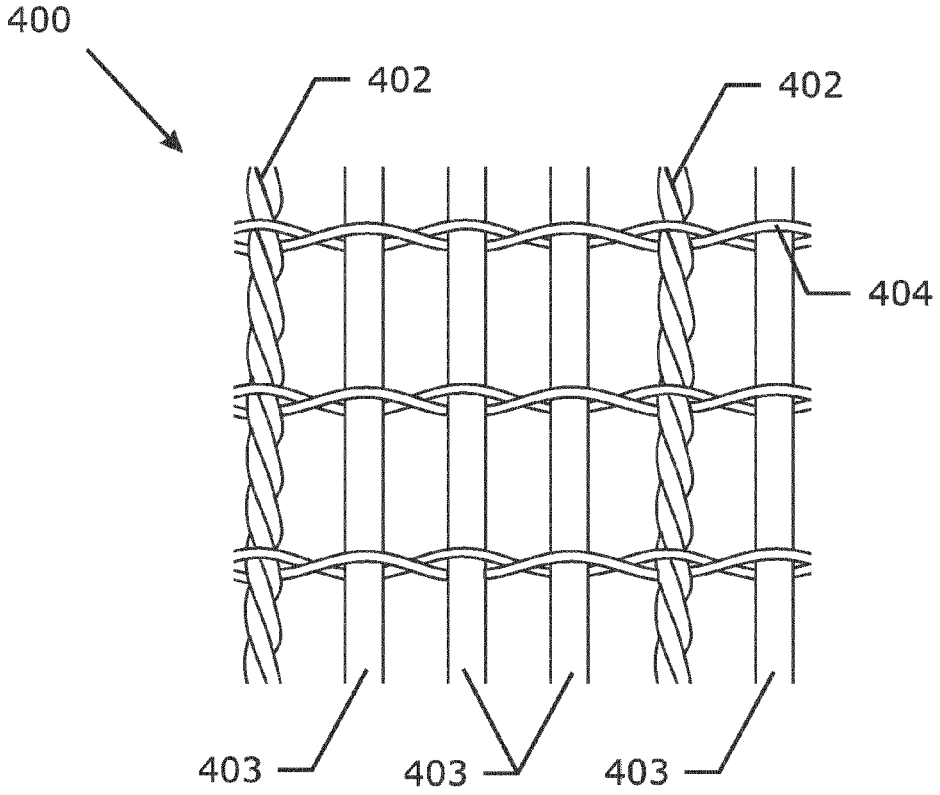
FIG. 4 is an illustration of a masonry reinforcement structure comprising an alternative woven structure.

FIG. 4 shows a second embodiment of a woven masonry reinforcement structure 400. The masonry reinforcement structure 400 comprises cords integrated in a woven structure 400. The woven structure 400 comprises in the warp direction a combination of polymer yarns 403 and steel cords 402. The weft direction comprises a polymer yarn 404.

Figure 5:
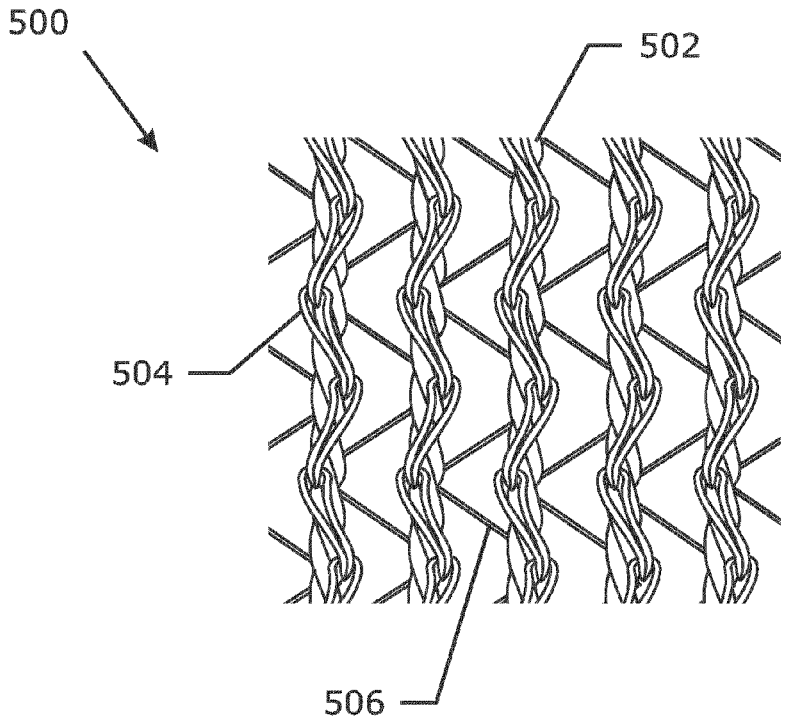
FIG. 5 is an illustration of a masonry reinforcement structure comprising cords in a knitted structure.

FIG. 5 shows a masonry reinforcement structure 500 comprising a knitted structure. The knitted structure 500 comprises steel cords 502 as pillar threads. The steel cords 502 comprise for example steel cords comprising 3 filaments having a diameter of 0.48 mm twisted together (3×0.48 mm). Another suitable steel cord comprises a cord having one core filament having a diameter of 0.6 mm and 5 filaments having a diameter of 0.73 mm around this core filament (0.6+5×0.73 mm). The structure further comprises yarn 504 and yarn 506 to keep the steel cords in their mutual parallel or mutual substantially parallel position. The yarn 504 is for example a multifilament yarn, preferably a polyamide, a polyether sulphone, a polyvinyl alcohol or a polypropylene yarn. The yarn 504 may also comprise a metal yarn.

The yarn 506 is connecting neighbouring steel cords 502. The monofilament yarn 506 is preferably a polyamide, a polyether sulphone, a polyvinyl alcohol or a polypropylene yarn. The yarn 506 may also comprise a metal yarn.

Figure 6:
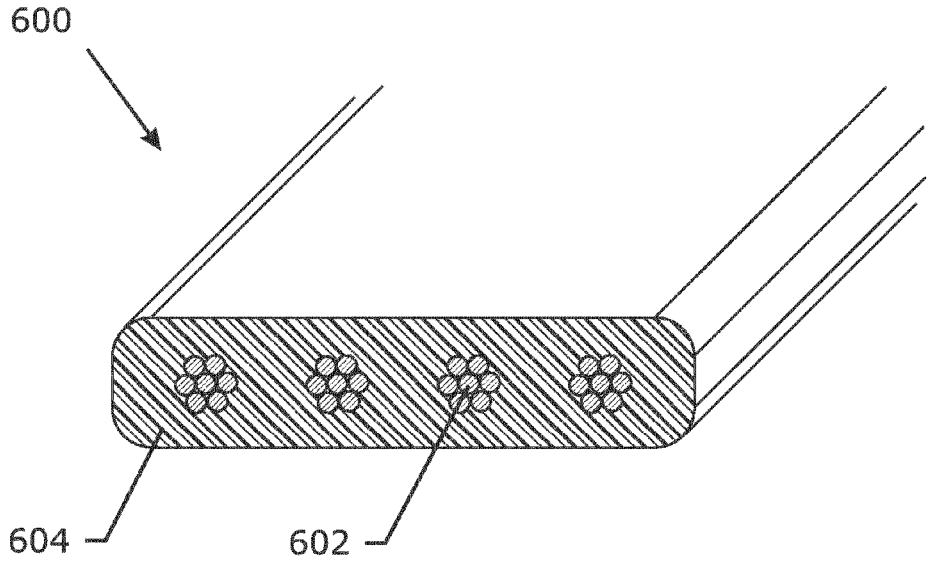
FIG. 6 is an illustration of a masonry reinforcement structure comprising cords embedded in a polymer material.

FIG. 6 is an illustration of a masonry reinforcement structure 400 comprising cords 602 embedded in strip of a polymer material 604.

The invention claimed is:

1. A masonry reinforced with at least one bed joint masonry reinforcement structure,
- said masonry comprising a number of layers of units or bricks,
- and further joints between two neighboring layers of bricks,
- whereby at least one joint of said masonry is reinforced with a bed joint reinforcement structure,
- said structure comprising at least two cords,
- said cords comprising metal filaments that are twisted together in order to allow easily rolling up and rolling out and in order to enable a flat position when rolled out,
- said cords being oriented parallel or substantially parallel in a length direction of said masonry, said cords being coupled to a non-metal substrate,
- said substrate being an open structure to allow mortar or glue to penetrate,
- said substrate comprising glass, carbon, or polymer based filaments or yarns,
- said cords having been bound to said substrate by means of a molten polymer that solidifies thereafter.

2. The masonry according to claim 1, wherein said metal filaments comprise steel filaments.

3. The masonry according to claim 1, wherein said cords are coupled to said substrate by gluing.

4. The masonry according to claim 1, wherein said cords are coupled to said substrate by at least one yarn.

5. The masonry according claim 1, wherein said cords are integrated in a woven structure, a knitted structure or a non-woven structure.

6. The masonry according to claim 1, wherein the metal filaments have a tensile strength higher than 1000 MPa.

7. The masonry according to claim 1, wherein said substrate consists or glass, carbon or polymer based filaments or yarns.

8. The masonry according to claim 7, wherein said glass, carbon or polymer based filaments or yarns run in weft direction.

9. The masonry according to claim 2, wherein said cords comprise between 2 and 12 steel filaments, each filament having a diameter ranging between 0.20 mm and 1.0 mm.

10. The masonry according to claim 1, wherein there is a distance between two neighboring cords, said distance ranging between 1.0 mm and 10.0 cm.

* * * * *